US005176706A

United States Patent [19]

Lee

[11] Patent Number: 5,176,706

[45] Date of Patent: Jan. 5, 1993

[54] SPINAL CURVATURE CORRECTION DEVICE

[76] Inventor: Jong W. Lee, 722 S. Western Ave., Los Angeles, Calif. 90005

[21] Appl. No.: 755,791

[22] Filed: Sep. 6, 1991

[51] Int. Cl.[5] ..... A61H 1/02

[52] U.S. Cl. ..... 606/237; 482/134; 606/241; 297/353

[58] Field of Search ..... 128/25 R, 33, 68, 69; 272/93, 130, 903, 120; 606/237, 241; 482/134, 137, 142; 297/314, 353, 383, 284 G

[56] References Cited

U.S. PATENT DOCUMENTS

| | | | |
|---|---|---|---|
| 1,527,754 | 2/1925 | Simon | 297/284 G |
| 3,595,223 | 7/1971 | Castagna | 128/33 |
| 3,815,586 | 6/1974 | Kazik . | |
| 4,054,319 | 10/1977 | Fogg, Jr. et al. | 297/353 X |
| 4,214,790 | 7/1980 | Sieber . | |
| 4,215,680 | 8/1980 | Okuda | 128/25 R |
| 4,347,840 | 9/1982 | Adams . | |
| 4,377,308 | 3/1983 | Pisanu | 297/353 |
| 4,662,361 | 5/1987 | Patterson . | |
| 4,732,423 | 3/1988 | Condon | 297/353 X |
| 4,750,478 | 6/1988 | Bergeron . | |
| 4,787,375 | 11/1988 | Krause . | |
| 4,802,462 | 2/1989 | Reiss et al. | 128/25 R |
| 4,824,169 | 4/1989 | Jarrell | 297/314 X |
| 4,860,733 | 8/1989 | Parker, Jr. . | |
| 4,902,008 | 2/1990 | Jones . | |
| 4,915,378 | 4/1990 | Abrahamian et al. . | |
| 4,981,325 | 1/1991 | Zacharkow | 297/353 X |
| 5,033,459 | 7/1991 | Burton . | |
| 5,046,694 | 9/1991 | Martin | 297/314 X |
| 5,070,863 | 12/1991 | McArthur et al. | 482/134 X |
| 5,076,264 | 12/1991 | Lonardo et al. | 602/21 X |

*Primary Examiner*—Robert Bahr
*Assistant Examiner*—Linda C. M. Dvorak

[57] ABSTRACT

An improved orthopedic device and method for correcting spinal curvatures of a patient by specific stabilization of the patient's pelvis and spine and then exercising the spine through active range of motions. The inventive method of spinal curvature correction re-educates the patient's muscles, ligaments, and nervous system which collectively are responsible for maintaining spinal posture, to properly maintain the spinal column in a desired alignment.

3 Claims, 2 Drawing Sheets

SPINAL CURVATURE CORRECTION DEVICE

BACKGROUND OF THE INVENTION

The present invention relates to the field of health care devoted to the maintenance of proper biomechanical functioning and alignment of the human skeletal system, particularly of the spine and its adjacent structures. The invention also reflects improved orthopedic devices and methods to treat spinal curvatures, subluxation, and areas around the spinal column.

It has long been recognized that proper alignment of the human skeletal system, particularly the spinal column and its related structures, is important to the proper biomechanical functioning of the human body. An improperly aligned spinal column, for instance, can lead to uneven weight and stress distribution along the patient's spine and pelvis which can lead to premature degeneration and arthritis of the spinal joints and related structures.

The purpose of this invention is to help provide the health care practitioner with an improved method and device for spinal curve correction to precisely and systematically treat patient spinal curvatures.

Many conventional techniques have been devised to effect changes to abnormal curvatures and subluxation of the spine. Such techniques include various chiropractic and osteopathic manipulative techniques, electrical muscle stimulation techniques, mechanical traction devices, self administered corrective exercises, and the like.

The conventional manipulative techniques involve correction of subluxation, osteopathic lesions, or fixations that contribute to spinal curvatures through the use of force administered manually or through an instrument. These techniques are usually effective in reducing joint fixations or altering the position of individual vertebrae but are not very effective in selectively strengthening the patient's muscles involved in maintaining proper spinal alignment for a more lasting correction of spinal curvatures.

Electrical stimulation has been used to attempt to selectively strengthen the various muscles around the patient's spine to bring the spine into a more ideal alignment. However, it is difficult if not impossible to selectively stimulate such internal muscles through layers of soft tissues and adjacent muscles overlying the muscles to be treated. Thus, when an electrical stimulus is applied such as with a pad placed on the skin, all patient muscles in that vicinity are collectively stimulated to various degrees depending on their location relative to the pad. The specificity of such approach is further prohibited in that not all the muscles in a given vicinity have similar action. Accordingly, when a muscle is stimulated to take advantage of the particular biomechanical action of the muscle, other surrounding muscles having different biomechanical actions will also be stimulated, reducing the effectiveness of this conventional approach.

Another conventional approach is the use of mechanical traction to correct spinal curvatures. This technique involves applying traction to the patient's spine in various positions to help straighten the spinal curvature. This approach is highly effective in stretching the ligamentous structures around the spine but does not selectively strengthen the patient's muscles involved in actively maintaining spinal alignment.

Self administered corrective exercises are also a conventional means after the patient has left the care of a health practitioner. Usually such exercises involve active stretching and "holding" of the patient's spine in the desired correction posture thereby to selectively strengthen the patient's muscles. These exercises may be effective in teaching the patient to hold the spine in a straight posture but are usually ineffective when the spine is in motion. As the patient's spine is moved away from the neutral position the mechanical leverage of the muscles affecting the spine changes. Accordingly, the patient's muscles must be able to adapt to the constantly changing leverage and be able to modulate muscle tone to maintain proper alignment throughout the range of motion of the spine. This typically is a complex process involving not only the relative strength of the muscles around the spine but also the ability of the patient's nervous system to accurately vary the muscle tone around the spine with information from a proprioceptive feedback system.

The present invention substantially improves the foregoing drawbacks by providing an improved orthopedic method and device. In accordance with one embodied form, the patient's spine is initially stabilized into a specific posture and maintained in that posture throughout various ranges of motion. By actively moving the patient's spine while the spine is stabilized into a specific posture in stationary as well a mobiel positions. Similarly, the present therapeutic method provides an effective means to selectively stretch the patient's ligamentous and muscular structures affecting spinal posture to more easily accommodate the corrected posture. Another important benefit is that the patient's nervous system, which controls spinal posture through proprioceptive feedback, learns to properly modulate the tone of various muscles during various phases of spinal motion to hold the spine in that specific posture during active movement.

In one embodied form the present invention provides an improved device to carry out the current method of spinal curvature correction in an effective and easy manner.

The embodied device comprises adjustable means for maintaining a patient in a seated position to allow tilt from side to side. Securement means are also provided to enable the patient's pelvis to be tightly secured while seated. An adjustable backrest means is also provided (tilting along a vertical axis, tilting up and down, and laterally adjustable) with a strap portion to enable the patient's upper back to be tightly secured to the backrest means. In addition, the improved device comprises means to enable the backrest to move relative to the seat means, with variable resistance, to allow active (patient provides the muscular force needed for movement) flexion and extension movement of the spinal column while the patient is secured to the device.

Resistance during movement on the device is provided by a pair of hydraulic shock absorbers, the anchoring point of which is adjustable to permit the level of resistance to be varied. One shock absorber provides resistance during flexion movement and the other shock absorber provides resistance during the extension movement of the spine.

Those skilled in the art will readily appreciate that optional features may also be provided to permit a variety of adjustments to the seat and backrest means, and to permit a variety of patient motion in addition to flexion/extension type movement (e.g., rotation, lateral flexion, later translation, and circumduction). Although the present device is primarily directed to correct thoracic, lumbar, and lumbosacral curvatures the device and method can also be utilized with added components to correct cervical curvatures and sacroiliac portion of the pelvis. These added components can be removable or as an integral part of the inventive device for correcting thoracic, lumbar, and lumbosacral curvatures.

In more detail, the improved device for correcting cervical curvatures is basically the same as the device for correcting thoracolumbar areas except that the head and the thoracic spine is stabilized to allow various guided motion of the cervical spine.

The inventive device in the embodied form for correction of sacroiliac joint malposition comprises means of securing both legs and thighs of the patient in a selected position, in addition to the seat means which functions to stabilize the innominate bones through contact with the ischial tuberosities. The device, however, enables the patient to actively exercise the body so as to allow ample movement of the sacrum against the innominate bones. The position of the thighs and legs, at their extreme positions, can alter the position of the sacroiliac joints. Applying the principle of the inventive method, the patient's legs and thighs are positioned so that the sacroiliac joints are moved in the desired direction. As the patient actively exercises in the device, the sacrum will move against the stabilized innominate bones thereby stretching and conditioning the patient's ligaments and muscles that affect the sacroiliac joints to hold the joints in a desired position.

Additional modifications may be made to the device by incorporating other therapeutic features as an integral part of the device. Modalities such as ultrasound, diathermy, high and low frequency electrical stimulation, heating or cooling means, traction, vibration, special raised areas along the contact surface for acupressure or trigger point therapy and the like can also be incorporated into the inventive device to enhance the patient's treatment and response.

SUMMARY OF THE INVENTION

The present invention provides an improved method and therapeutic device for correcting a patient's spinal curvature and/or joint malpositions.

The inventive method comprises the steps of stabilizing the patient area to be treated into a prescribed corrective position, and thereafter implementing a series of repetitive active guided procedures while the area under treatment is stabilized.

In the case of spinal correction, the active motion manipulation while the spine is stabilized, results in conditioning muscles, ligaments, and the posture controlling nervous system to move and hold the spine in that particular fashion as prescribed by the stabilization of patient's spine in a desired position throughout the range of motion of the active exercises.

In more detail, in the treatment of a thoracolumbar curvature, where the thoracic cage has moved laterally toward the right side (right lateral translation) relative to the lumbar spine, the patient is stabilized within the orthopedic device by adjusting the backrest means laterally to the left to cause left translation of the patient's thoracic cage. After stabilization the patient is put through active flexion and extension exercise of the spinal column.

By shifting the curvature to the opposite side, the patient's muscles that have the most leverage in the original position are put into a disadvantage while at the same time the muscles that tend to maintain the curvature in the new position are brought into better leverage By exercising the patient's back and abdominal muscles through active extension and flexion movement, the muscles with favorable leverage are most heavily exercised as the nervous system works those muscles that have the most favorable leverage in a given movement.

The manipulated patient muscles end up stronger and have better tone to help maintain the patient's curvature in a more neutral posture during both movement and stationary postures. Furthermore, the patient's nervous system is conditioned to contract those muscles that are brought in to better leverage by the stabilization, and "remembers" to favor those muscles during movement even without the stabilization.

The inventive device in one embodied form permits only flexion and extension type movement for the patient's thoracic, lumbar, and lumbosacral areas. It also does not have the capacity to fully vary the sitting means and backrest means to cover all possible postures for the thoracolumbar area. The disclosed device's primary purpose is to demonstrate the present method of curvature correction. It must be noted that it is the method that is novel, and the device itself is secondary to the method.

DETAILED DESCRIPTION OF THE PREFERRED EMBODIMENT

Figure 1:
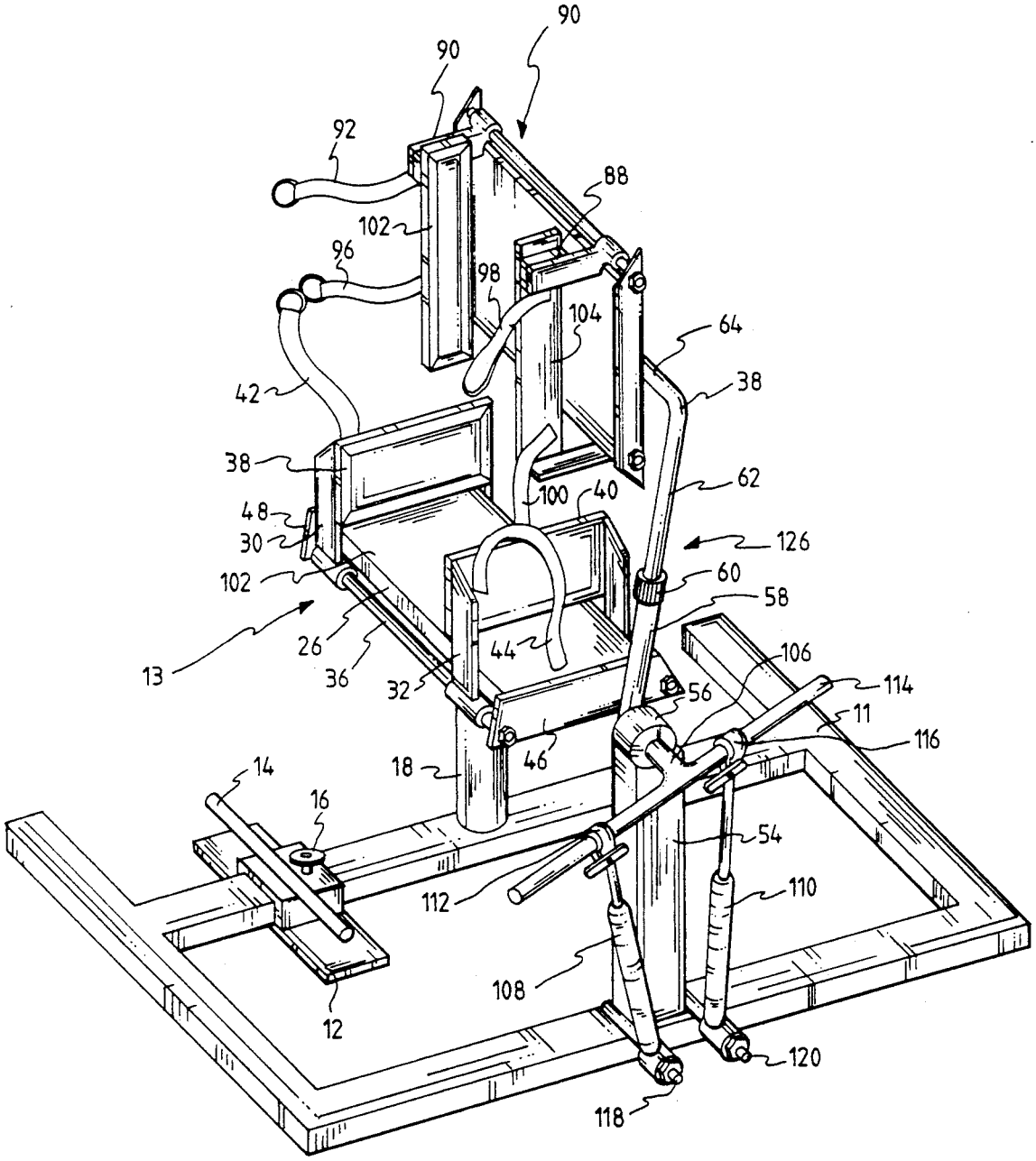
FIG. 1 is a perspective view showing one embodiment of the present invention.

Referring to the drawings, wherein like numbers represent like parts throughout the several views, there is generally disclosed at 10 a spinal curvature correction device. The spinal curvature correction device 10 comprises of a base frame 11 to which feet stabilizer 12 is movably attached. Feet stabilizer upper part 14 is welded to feet stabilizer 12. Bolts 16 are secured into the feet stabilizer 12. The feet stabilizer 12 can be moved along the base frame 11 to allow for different size individuals.

Seat support 18 is vertically welded to the base frame 11. Seat support part **18*b* is secured to seat support 18 by a clamp 18*c***. This arrangement allows the height of the seat to be adjusted. It also allows the seat to be adjusted into various positions by rotation movement along the vertical axis.

A "U" shaped part 20 is secured to seat support part **18*b*. Part 22 and 24 is attached to seat body 26. Seat 26 is movably secured to part 20 through parts 22 and 24 with a bolt 26 and bolt 28 which preferably has a plastic knob. This arrangement allows tilting movement of the seat body 26**.

Side support frames 30 and 32 are attached to guide rods 34 and 36. Side support bodies 38 and 40 are attached to side support frames 30 and 32 respectively. The side support bodies 38 and 40 are preferably covered with a cushioning means such as foam covered with vinyl. A non-slip material may be desirable over vinyl. The straps 42 and 44 are attached, in a well known manner, to the side support bodies 38 and 40 respectively. The side support frames 30 and 32 are secured to seat side frames 46 and 48 by nuts. Side frames 46 and 48 are attached to seat body 26 at either ends. The seat body 26 is covered by cushioning means similar to the one found on side support bodies 38 and 40. A crank screw 50 is connected to side frames 46 and 48 and to the threaded portion of side support frames 30 and 32. Knob 5 is attached to crank screw 50. These arrangements allow the side supports to be tightened against the hip and proximal lateral thigh areas by turning the crank knob 52. The side supports prevent any sliding to the side when the seat 13 is tilted to one side. The straps 42 and 44 provide additional support and prevents the patient's pelvis from separating with the seat surface during active exercise.

Vertical frame 54 is welded to main frame 11. Ball bearing assembly 56 is welded to vertical frame 54. The motion arm 58 and part 106 are attached to the ball bearing assembly 56 in a conventional manner. Motion arm extension 62 is attached to motion arm 58 and secured by part 60. Motion arm extension 62 is bent 90 degrees at 38 so that motion arm extension portion 64 is horizontal.

Figure 4:
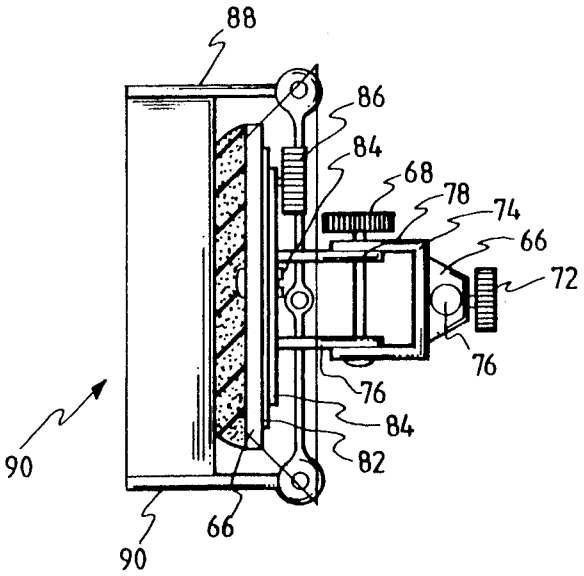
FIG. 4 is a side view of the backrest means of the present embodiment.
Figure 3:
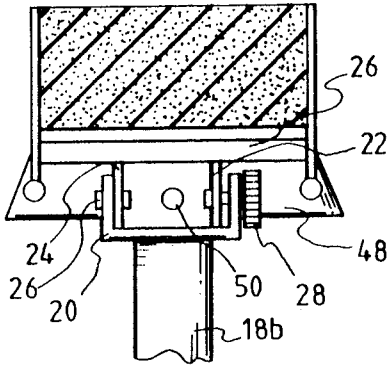
FIG. 3 is a right side view of the sitting means of the present embodiment.
Figure 2:
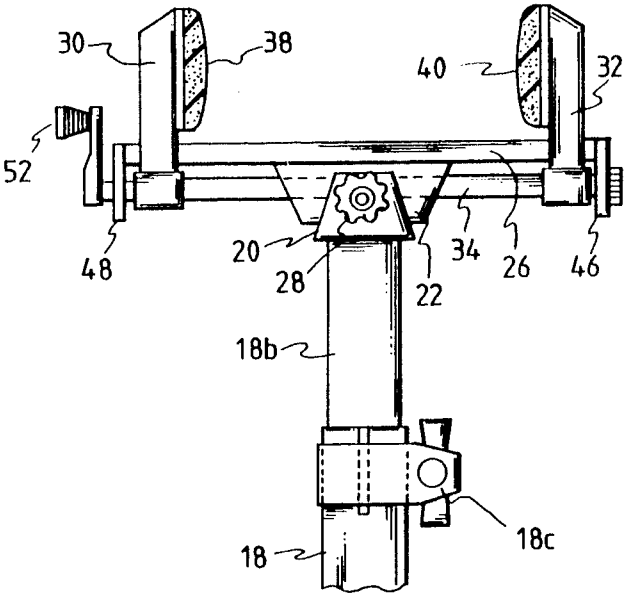
FIG. 2 is a frontal view of the sitting means of the present embodiment.
Figure 5:
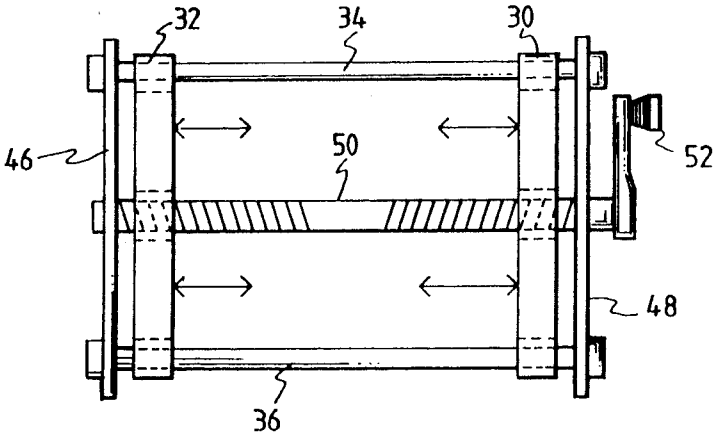
FIG. 5 is a partial underside view of the sitting means of the present embodiment.

Now referring mainly to FIG. 4, motion arm extension portion 64 is attached to part 66 of the back rest assembly 90, through hole 70. Screw part 72 is threaded into part 66 to secure motion arm extension portion 64. This arrangement allows the whole backrest assembly to be adjusted by sliding it laterally across the motion arm extension portion 64. It also allows tilting motion of the backrest means along a horizontal axis.

Part 74 is welded to part 66. Part 76 and 78 are welded to circular plate 84 which in turn is joined to circular plate 82 at the center by bolt 84. Bolt 86 goes through both the two circular plates 82 and 84. Circular plate 84 has a semi-circular slit through which bolt 86 goes through to screw into circular plate 82. The parts 76 and 78 are joined to part 74 by bolt 68. Circular plate 82 is attached to backrest body 66 by well known means. These arrangements allow the backrest surface to be adjusted through rotation motion allowed between the circular plates 82 and 84. The semi-circular slit on plates 84 represents the range of rotation movement possible. As the backrest body 66 is rotated, with the bolt 86 loose to allow movement, the bolt 86 will move along with circular plate 82, through the semi-circular slit on circular plate 84. About 30 degrees rotation to either side from a neutral portion should be ample enough for our purposes.

The connection of parts 76 and 78 to part 74 by a bolt 68 allows tilting movement of the backrest means along a vertical axis. Here also, allowing 30 degrees motion on either side should be sufficient.

Backrest side support members 88 and 90 are attached to backrest body 66 through similar parts as in the seat assembly. Straps 92, 94, 98, and 100 are attached by well known methods to side support bodies 102 and 104. The side supports are used to tightly stabilize the upper body to the backrest means to minimize sliding laterally during active exercise. The straps provide additional support and allow the backrest means to follow the movement of spinal flexion by the user.

Now referring to FIG. 1, rod 114 is welded to part 106. Hydraulic shocks 108 and 110 are secured to rod 114 through clamp parts 112 and 116 and to the base frame 11 through parts 118 and 120, which are welded to the base frame 11. The hydraulic shocks 108 and 110 are one-way shocks having resistance only when they are pulled out. Hydraulic shock 108 provides resistance during flexion movement of the user, when the backrest means will move forward, thereby rotating part 106 so as to move the posterior part of the rod 114 away from the part 120 causing the shock 108 to be stretched or pulled out. Similarly, when the user moves to extend the spine, the backrest means is moved backward, causing the anterior portion of the rod 114 to move away from part 118, thereby causing the shock 108 to be stretched.

The clamp type parts 116 and 112 allow the shocks to be secured to rod 114 at varying locations along the length of the rod. Resistance is reduced by adjusting the clamp part 116, 112 closer to the part 106, or to the center since then the rod has better leverage to more easily stretch the shock. To increase the resistance, the clamp part 116, 112 is adjusted away from the center, or part 106.

This particular embodiment utilizes hydraulic shocks for resistance but any other means of resistance, well known to the industry, may be substituted, such as weights, elastic bands, flywheels, springs, etc.

In operation, before the patient is seated on the device 126, the operator readies the device 126 by adjusting both the sitting means 102 and the backrest means 90 based on the examination and, preferably, radiographic studies of the spinal posture of the patient. In addition, the resistance level is set to a minimum level for both the flexion and extension movement.

For most cases, the initial sessions with the device 126 would be done with both the sitting and backrest means in a neutral position to first get the patient used to the actions of the device. After the initial sessions the sitting 102 and backrest means 90 would be adjusted so that when the patient is properly strapped into the device 126 the spine would be in a near perfect alignment. If the patient has a curvature of the spine, putting the patient on the device 126 with the backrest 90 and sitting means 102 in a neutral position may not force the spine into a neutral posture. It may be necessary to slightly "overshoot" and adjust the sitting 102 and backrest means 90 to tend to put the spine into a slight reverse curvature to straighten out the spine.

The patient is properly strapped onto the device by first adjusting the height of the sitting means 102 by manipulating the clamp part **18*c* and either pushing in or pulling out the part 18*b* against part 18. The most ideal height is the height that allows the sacroiliac joint of the patient to be at the same height as the ball bearing assembly 56. Next, the patient is seated onto the top surface of the seat body 26 and the crank screw 50 is turned by using the knob 52, either clockwise or counterclockwise depending on the direction of the threading of the crank screw 50, to tighten the side support bodies 30 and 32 against the patient's lateral hip and proximal thigh areas to prevent any lateral sliding. The straps 42 and 44 are fastened over the anterior proximal thighs of the patient to firmly secure the ischial tuberosities of the pelvis against the superior surface of the seat body 26. Then, the patient's back is placed against the anterior surface of the backrest body 66, and the height of the backrest means 90 adjusted so that the superior surface of the side support members 88 and 90 are just below the arm pits of the patient. The height of the backrest means 90 is adjusted by manipulating part 60 of the motion arm 58 and pushing or pulling the motion arm extension 62 relative to the motion arm 58**.

After the proper height has been set, the thoracic cage is strapped tightly against the backrest means 90 so that the patient's back and backrest means 90 can move as a unit.

Lastly, the feet stabilizer is adjusted for the length of the patient's legs. The optimal position is the position that allows the patient's thighs to be in a horizontal fashion.

Once the patient is securely strapped in, the patient is instructed to slowly flex and extend the trunk of the body. This flexion and extension of motion of the spine is guided in a straight line since the ball bearing assembly part 56 only allows rotation along a single plane.

The resistance settings of the device 126 are gradually increased over the treatment sessions to the point where the patient will get a fairly good workout, but never to the point where possibility of injury due to too much force or exertion is a significant factor.

As the patient is accustomed to the near neutral position of sitting 102 and backrest 90 settings, the sitting and backrest means are gradually adjusted over a number of sessions to put the spine into an opposite curve of the patient's original curvature, into a complete mirror image.

The patient's progress is checked before and after each treatment session to monitor the progress. The treatment can be administered in an accelerated manner or in a more steady manner by varying the rate at which the sitting and backrest means are adjusted to hold the spine in a complete reversal of the original spinal curvature.

Once the patient's spine is brought to a neutral position during examinations before and after the treatment for a few sessions, the process of gradually adjusting the sitting and backrest means to stabilize the spine into an opposite curvature, while the device 126, is reversed.

The sitting and backrest means are gradually adjusted back into the neutral position over a number of sessions. This may be considered to be a "retainer" stage of correction where the spine is continually taught to "remember" this ideal posture.

The treatment may be considered completed if the patient retains the new posture over a period of a few months without specific treatment.

For a more heavy duty model of the device 126, the whole vertical frame 54, ball bearing assembly 56, motion arm components 58, 60, 62, 66, 64, and part 106, rod 114, the hydraulic shocks 110, 108 and related parts 112, 116, 118, 120, and the part of the base frame 11 that supports the vertical frame 54 can be duplicated in a mirror image on the right side of the device 126 and connected together at part 64. This version of the preferred embodiment will be stronger and have smoother motion than the current version at the expense of increased complexity and cost.

The preferred embodiment of the current method is that the patient be exercised in the sitting portion with flexion and extension of the trunk as the main active range of motion. However, as has been previously stated elsewhere in this disclosure, devices can be designed to offer other directions of range of motion such as lateral flexion, lateral translation, rotation, or circumduction.

Furthermore, the patient may not necessarily be in a seated position for the current method of spinal curvature correction to be effective. It is possible to administer the current method of treatment in a variety of positions such as standing, reclining, upside-down, etc.

The important points of this method is that the area to be treated be stabilized into specific postures, preferably at both ends, while allowing active range of motion exercise to be performed involving the muscles around the area under treatment.

It is also important to note that the actual gross movement of an area to be treated is not the only way of exercising the muscles around that area. For example, simple walking motion in a standing position can be utilized to cause muscle contraction in the spinal column while the spine is stabilized into a specific posture.

Hence, the scope of the current method covers any exercise position of the patient on a device, any types of movement of any parts of the body that causes contraction of the muscles affecting the posture or joint position of the area under treatment, and all devices designed to carry out any combination of the above mentioned possibilities, with or without additional feature such as vibration, electrical stimulation, etc.

I claim:

1. An orthopedic device for stabilization of a user's spline into a prescribed corrective position, the device comprising:

a base frame member having adjustable seat means disposed thereon, said adjustable seat means having a front, a rear, a first side and a second side; said seat means being capable of multiple positions to cause the pelvis to tilt in various directions to effect postural changes in the spline of a user seated upon said seat means; said seat means being pivotal from side to side about an axis generally parallel to said first side and said second side and extending from said seat means front to said seat means rear;

backrest support means attached to said base frame member for supporting an adjustable backrest substantially above and in alignment with the rear of said seat means;

an adjustable backrest having a front face, a back face, a top, a bottom, a left side and a right side; said adjustable backrest capable of multiple positions to stabilize the upper back of a user seated upon said means in various positions of lateral flexion, lateral translation, and rotation relative to the pelvis, thereby effecting postural changes in the spine; said adjustable backrest being pivotal from left side to right side about an axis generally parallel to said left side and said right side and extending from said backrest top to said backrest bottom; said adjustable backrest being rotatable about a generally horizontal axis extending from said backrest front fact to said backrest back face;

a first pair of laterally adjustable support means adjacent respective sides of said seat means, said first pair of laterally adjustable support means being slidingly adjustable with respect to said seat means from side to side to bear against the user's pelvis;

a second pair of laterally adjustable support means adjacent respective sides of said backrest, said second pair of laterally adjustable support means being slidingly adjustable with respect to said backrest means from said side to side to bear against the user's upper back;

said first and second pairs of laterally adjustable support means cooperating to provide lateral translation of the upper back of the user with respect to the pelvis;

first securement means for securing a user's pelvis tightly in said seat means;

second securement means for securing a user's upper back tightly to said backrest; and resistance means attached to said backrest support means for allowing relative movement of said backrest with respect to said seat means under various resistance or load.

2. An orthopedic device as in claim 1 wherein said resistance means is capable of a various resistance settings, said resistance means selected from the group consisting of hydraulic shocks, springs, and elastic bands.

3. An orthopedic device as in claim 1 further comprising various physiological therapy means selected from the group consisting of ultrasound, diathermy, high and low frequency electrical stimulation, massage, heat, and cold.

* * * * *